United States Patent [19]

Macho et al.

[11] 4,383,488

[45] May 17, 1983

[54] FOLDABLE STOOL

[75] Inventors: Jan M. Macho, La Canada; Richard O. Oxford, Los Angeles, both of Calif.

[73] Assignee: Dial Industries, Inc., Los Angeles, Calif.

[21] Appl. No.: 180,413

[22] Filed: Aug. 22, 1980

[51] Int. Cl.[3] ..... A47B 3/00

[52] U.S. Cl. ..... 108/129; 16/DIG. 13; 16/260; 108/130; 108/156

[58] Field of Search ..... 108/132, 131, 130, 129, 108/43, 156, 128, 129; 16/DIG. 13, 260

[56] References Cited

U.S. PATENT DOCUMENTS

| | | | |
|---|---|---|---|
| 1,203,783 | 11/1916 | Reischmann | 108/132 |
| 2,423,529 | 7/1947 | Taylor | 108/131 X |
| 3,271,075 | 9/1966 | Good | 108/129 |
| 3,709,158 | 1/1973 | Kidd | 108/43 |
| 4,302,866 | 12/1981 | Irvin | 16/DIG. 13 |

FOREIGN PATENT DOCUMENTS

| | | | |
|---|---|---|---|
| 1551827 | 9/1979 | United Kingdom | 16/DIG. 13 |

*Primary Examiner*—James T. McCall
*Attorney, Agent, or Firm*—E. Barron Batchelder

[57] ABSTRACT

A folding stool including a top having a depending peripheral skirt and support leg members operatively mounted on the underside of the top, and inward of the peripheral skirt. Leg members are mounted at opposite ends of the stool. Each leg member includes two legs interconnected as a pair. The leg members are pivotally moveable to an extended stool support position, and to a retracted folded position within the confines of the skirt. Selectively engageable double leg locking means are provided, with portions thereof being on the stool top and portions thereof being on the legs of the leg members. The locking means are functionally operable for locking the leg members in the extended stool support position. Engagement and disengagement of the double locking means is manually effected by rectilinear movement of the leg members, toward the stool top when in the extended stool support position. Pivotal movement of the leg members is prevented with the locking means operatively engaged.

21 Claims, 10 Drawing Figures

FIG. 8.
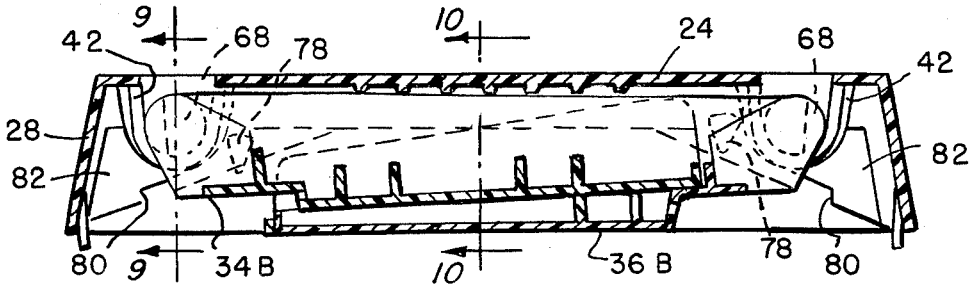
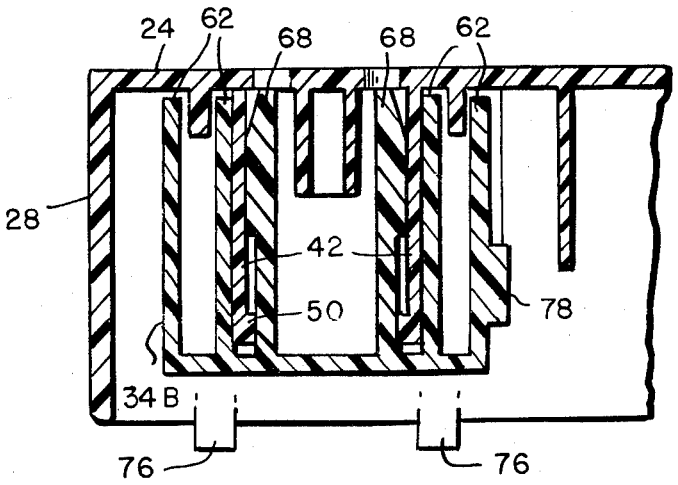
FIG. 9
FIG. 10.
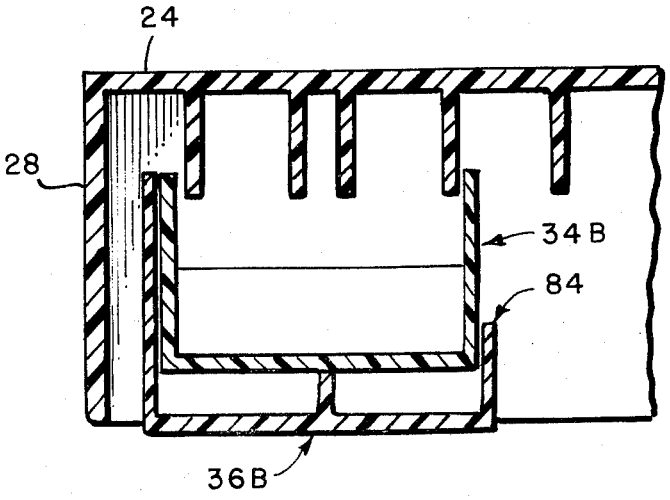

FOLDABLE STOOL

TECHNICAL FIELD

The present invention relates to a folding article of furniture, and more particularly to a folding step stool preferably formed of a molded plastic material, and wherein leg members are pivotally mounted to ends of the underside of a work surface or top. The leg members are operable for selective placement into a locked extended stool support position and into a folded retracted position beneath the stool top within the confines of a depending peripheral skirt for containment therewithin.

BACKGROUND OF THE INVENTION

Articles of furniture such as stools, tables, chairs and the like, having folding support legs are known. Typical constructions have included means operable for selectively pivoting support legs into extended support positions, and retracted and folded positions within peripheral dimensions of the article. Some known constructions have also included means for locking the legs in extended and retracted positions.

Known types and constructions of furniture have utilized different materials, including wood, metal, plastics and the like. Many of these known prior constructions, however, consisted of expensive materials, and the construction involved complicated and expensive fabrication.

Safe locking means for locking of support legs in an extended article support position have, in some known constructions, involved complicated mechanisms which added to expense and constructional fabricating difficulties. Such prior constructions were frequently fraught with operational problems and difficulties, and safety in use was problematical.

Various types and articles of furniture have been manufactured or fabricated from plastic materials. As is well known, some such plastic materials, especially when fabricated into configurations where stresses and strains on the structural materials or parts are inherent or present, were susceptible to structural failure or breakage. Attempts to strengthen the article has frequently involved excessive material use, and/or composite structural features, all of which add weight, cost, and fabrication difficulties.

In the past, it has proven difficult to provide a low-cost, easily manufactured and assembled article of furniture, such as a step stool, which incorporates structural features permitting selective movement of support leg members from a folded position, within the peripheral confines or configuration of the article, to an extended article or stool support position, where efficient interengaging position locking means could be activated.

OBJECTIVES OF THE INVENTION

It is therefore an object of the invention to provide a furniture article, particularly a folding step stool, fabricated from plastic material, which is so designed as to provide increased safety of the stool when in use for person support.

The present invention more specifically provides a folding step stool formed of injection molded plastic material, including a top or top assembly, and separately formed leg members, with the construction permitting easy and facile interconnection and/or assembly of the leg members to the top.

More specifically, the present folding step stool has means on the underside of a top member which pivotally mount stool support leg members, and the mounting means additionally permit a folding and retraction of the leg members within the peripheral outline or confines of the stool when in an inoperative position. Interconnecting or interengaging means comprising the mounting for the leg members are so designed that, when the legs are in an extended stool support position, a rectilinear movement of the leg member interengages plural locking means. Portions of the locking means are formed on the stool top, and portions on the legs. The plural locking means, when operatively interengaged, enhance operational safety, and additionally serve, through the utilization of the plurality of means, to substantially diminish or negate breakage of portions of the plastic material comprising the locking means. This latter feature obviously enhances and improves functional use and life longevity of the stool.

An additional object, and inherent advantage or characteristic of the present step stool construction, results from inherent flexibility of the plastic material from which constructed. This flexibility permits, in combination with the configuration of interengaging portions, a snap-in type of interconnection of the legs with the top member. The construction thereafter permits easy movement of the legs to and from operational and/or retracted positions. The snap-in interconnection, in conjunction with the size and configuration of interconnecting parts, effectively prevents removal of the leg members from connected engagement with the stool top following completion of assembly.

The folding stool of the invention preferably is fabricated from an inexpensive plastic material, such as polystyrene, which is susceptible of molding by an injection process, the resultant structure being not only inexpensive but safe in operation, and having minimal breakage characteristics. The end product furthermore presents a very pleasing appearance and when in the folded or collapsed condition is susceptible of easy storage.

An additional feature of the invention resides in the structural and dimensional features of individual legs which are formed in pairs and attached at opposite ends of the stool top. The legs are configured as substantially U-shaped open channels. The widths of the legs of the leg members at one end of the stool top are greater than the leg widths of the leg members at the opposite end. This difference in width, as also the spacing of the connecting or mounting means for the respective leg members, is such that when in folded position, the larger width legs engage over and around the more narrow legs to facilitate confinement of both leg members within the peripheral confines of a depending skirt surrounding the stool top.

Still other objects, features and advantages of the present invention will become readily apparent to those skilled in this art from the following detailed description, wherein only a preferred embodiment of the invention is shown and described, simply by way of illustration of the best mode contemplated currently for carrying out the invention. As will be realized, the invention is capable of other and different specific embodiments and the several details as shown and described are capable of modification in various, obvious respects, all without departing from the invention. Accordingly, the drawings and description are to be regarded as illustrative in nature, and not as restrictive.

BRIEF DESCRIPTION OF THE DRAWING FIGURES

The accompanying drawings illustrate a preferred embodiment of the invention and, when taken together with the description, serve to explain the principles of the invention.

FIG. 8 is an enlarged sectional view taken on line 8—8 of FIG. 1;

FIG. 9 is a fragmentary, enlarged sectional view taken on line 9—9 of FIG. 8; and FIG. 10 is a fragmentary, enlarged sectional view taken on line 10—10 of FIG. 8.

DESCRIPTION OF THE PREFERRED EMBODIMENT

Figure 1:
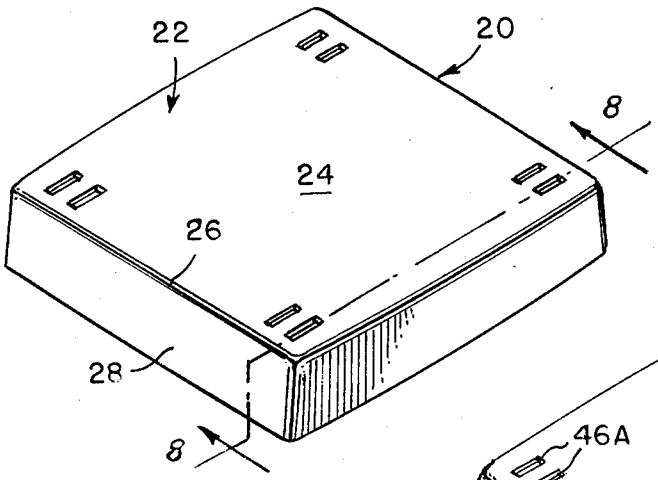
FIG. 1 is a perspective view of the step stool of the invention in a collapsed or folded condition.
Figure 2:
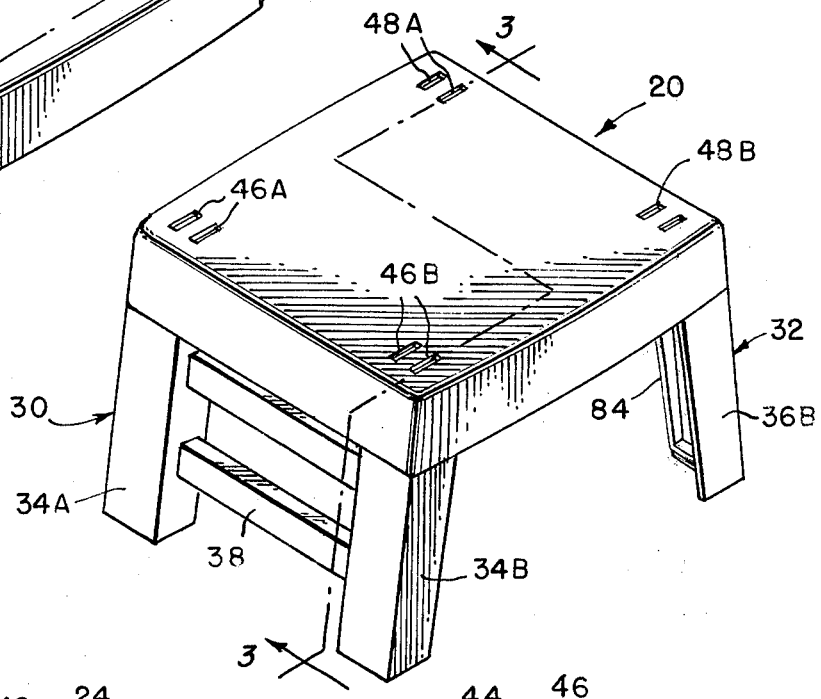
FIG. 2 is a perspective view of the step stool of the invention in an erected operative condition of the stool.

Referring now to the drawings, and particularly FIGS. 1 and 2, the folding step stool of the invention is generally designated 20. The stool as shown in FIG. 1 is in a folded or collapsed condition. In FIG. 2 the stool is shown in an erected condition for use. The stool includes a top 22 which includes a generally planar top surface 24. The overall outline of the top is substantially rectilinear, with slightly curved edges as indicated at 26. A depending peripheral skirt 28 extends downwardly from and along the four edges of the top surface 24.

Leg members 30, 32, generally designated, are operatively attached to the top 22, as will be described in greater detail hereinafter, and serve in the position shown in FIG. 2 to place the stool in a useable or operable condition. It will be noted that the leg members 30, 32 at opposite ends or sides of the stool are slightly angularly disposed with respect to one another, in a manner to provide stability and strength to the stool.

The leg members 30, 32 each include a pair of legs. The legs of leg member 30 are designated 34A, 34B and the legs of leg member 32 being designated 36A and 36B. The legs in the pairs are interconnected by rungs 38. As will be discussed hereinafter, while each of the legs are generally of U-shape or channel shape in cross-section, and while generally similar, the legs in the two leg members do have specific structural and dimensional differences. This is to permit folding and confinement of the leg members beneath and within the confines of the peripheral skirt 28. The folded condition is that of FIG. 1 and it is seen that no portion of the leg members protrude from the skirt. This construction permits easy and out-of-the-way storage when the stool is not in use.

Means are provided for operatively attaching the leg members 30, 32 to the underside 40 of top 22. Generally the attachment means are such that the individual legs of the leg members, joined as a functional pair, can be pivoted from the stored condition of FIG. 1 to the extended position shown in FIG. 2, the latter being the operative condition of the stool. The connection or attachment means generally includes ears or lugs 42, 44 for the legs of leg members 30, 32 respectively. These lugs or ears have a generally curvilinear bottom U-shaped configuration, are integrated with the undersurface of the top, and depend downwardly therefrom in spaced pairs as shown at 44A and 44B in FIG. 4. These ears or lugs are spaced respectively outwardly of adjacent slots 46A, 46B provided in pairs for the legs 34A, 34B respectively, or slots 48A, 48B for legs 36A, 36B respectively. As will appear hereinafter, the spacing between the ears or lugs in the sets at opposite edges of the stool top differ slightly to accommodate different widths of the legs in the two leg members as mentioned above.

Each of the lugs or ears has on its inner or facing surface, with respect to a pair thereof, an outwardly extending guide forming ridge 50. This ridge 50 is substantially identical on each of the ears or lugs, and is of a generally open topped, curvilinear bottom, U-shaped configuration. These guide forming ridges 50 include guide surfaces 52, generally perpendicular to the lateral surfaces of the ridges, and curvilinear at the base of the U configuration.

Figure 3:
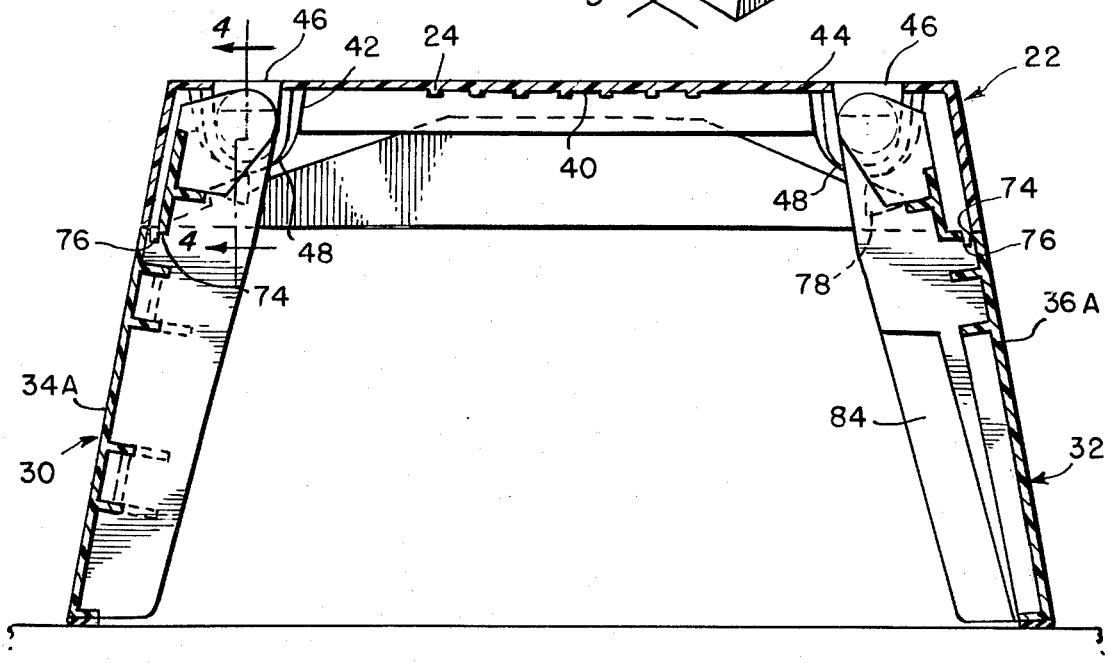
FIG. 3 is an enlarged sectional view taken on line 3—3 of FIG. 2.
Figure 4:
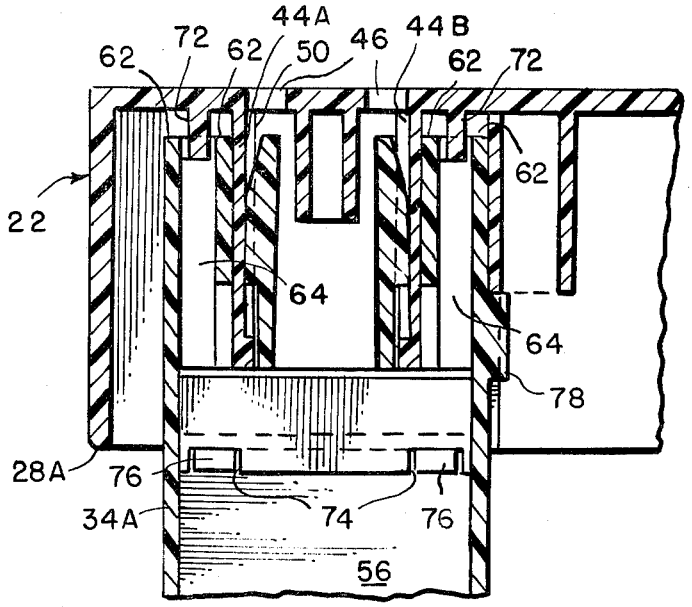
FIG. 4 is an enlarged fragmentary sectional view taken on line 4—4 of FIG. 3 showing in greater detail the interfitting of portions of a leg member with the stool top.
Figure 5:
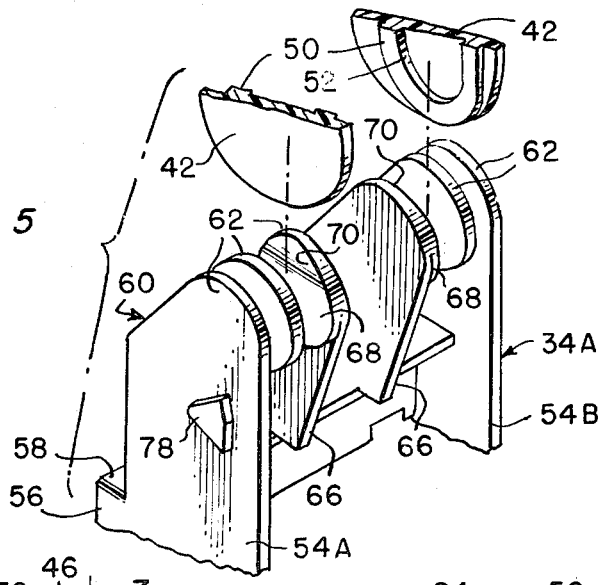
FIG. 5 is a fragmentary, exploded, perspective view of leg mounting means for the stool.

Referring now to FIGS. 4 and 5, leg attachment means for leg 34A are shown and the construction is generally similar to those of the other legs. The leg includes sides 54A, 54B in spaced parallel relationship, and interconnected by a front face or web 56. As shown in FIGS. 3 and 5, the legs are provided with an inset step or ledge 58 which functions as an engagement surface or ledge to engage the lower edge 28A of peripheral skirt 28 when the legs are in the extended or erected position shown in FIGS. 2, 3 and 4. The step constitutes not only an abutting stop ledge but further, as appears hereinafter, forms a part of locking means to lock the legs in the extended position.

Inset upper terminal ends 60 of the legs each have spaced parallel curvilinear ears 62 and with an intermediate spacing and strengthening web 64 therebetween. Spaced inwardly from the innermost ones of the spaced curvilinear ears 62, and integrated with the legs, are ears 66 having generally the same terminal configuration as the curvilinear ears 62. Each of these ears 66 has a curvilinear or generally circular contoured knob or projection 68 extending from that side thereof facing adjacent ones of curvilinear ears 62. These curvilinear or circular shaped knobs or projections 68 additionally have tapered or bevelled ends 70 thereon.

Substantially flat faced teeth 72 extend downwardly from the undersurface 40 of the top intermediate each pair or set of the parallel spaced curvilinear ears 62. These teeth, being juxtaposed or inserted between the two ears, serve as a guide for the same when in assembled relationship. In assembling the legs to the top, the tapered surface or bevelled ends 70 on knobs 68 are positioned on opposite sides of the ears 44 and, due to the resilience of the material of ears 62, knobs 68 can be forced over the ears 42 and guide-forming ridges 50 by a rectilinear movement of the leg. Following this forced movement of the leg, the knobs 68 will pass over the ridges 50 and will then snap back or resume their original position, with the knobs operatively positioned with the guides formed by ridges 50, and in operable contact with the curved or curvilinear surfaces 52. This interconnection provides for a pivoting or swinging movement of the legs in the guides.

Figure 6:
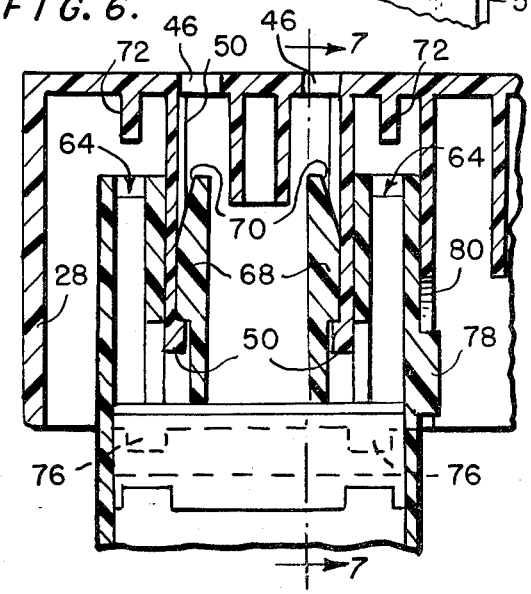
FIG. 6 is a view similar to FIG. 4, showing the legs rectlinearly moved or withdrawn from the erected position of FIG. 4, to a rectilinearly remote position wherein they can be collapsed or folded to the inoperative position.
Figure 7:
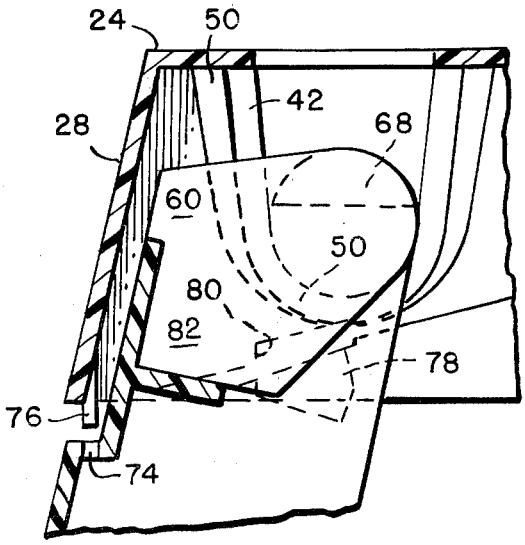
FIG. 7 is a fragmentary sectional view taken on line 7—7 of FIG. 6.

The ledges of insets 58 of the legs have spaced openings 74 therein. Spaced, downwardly projecting legs 76 are provided on the inner sides of the peripheral skirt. After the legs are assembled to the top as above set forth, then the legs can be rotated by coaction between the knobs 68 and guides 52 to the erect position shown in FIGS. 6 and 7. In this position the openings 74 and lugs 76, while substantially aligned, are spaced from one another. Thereafter, upon further rectilinear inward movement of the legs, which is permitted by the open top configuration of the guides formed by ridges 50, the projecting lugs 76 will engage in the openings 74. This coaction of lugs 76 and openings constitutes one of the double leg locking means referred to above. The second of the leg locking means is provided by interaction of generally triangularly shaped projections 78 on the outer faces of inset upper terminal ends 60 of the legs (see FIGS. 5, 7) and indentations 80 in webs 82, which latter constitute strenthening means extending downwardly from the undersurface of the top. The rectilinear movement of the legs engages the triangular shaped projections 78 in the indentations and this constitutes the second of the double locking means. Of significance, in order to disengage the locking means to rotate the legs to the retracted or folded condition, the leg must first be rectilinearly withdrawn or moved to disengage the locking means, and subsequently the legs can be rotated or pivoted by coaction of the knobs and guides.

Referring to FIGS. 2 and 10 in particular, it will be seen that the legs 36A, 36B have a greater width than do the legs 34A, 34B. Additionally, the inner side portion of legs 36A, 36B are cut away at 84. Due to this construction, when the legs are folded to the position shown in FIG. 8, the legs 36A, 36B can be engaged over and around the outer configuration of the legs 34A, 34B and can be entirely retracted within the confines of the peripheral skirt 28.

The drawings shown internal strengthening ribs, not numbered, provided at various locations along the inner surfaces of the top and the inner surfaces or faces of the legs for obvious reasons.

The foregoing description, when taken together with the accompanying drawings, discloses in detail a single preferred form of the invention and the operation thereof. While a single preferred form has been set out, it is within the concept of the invention to slightly modify portions thereof. A principle feature of the invention resides in the construction for mounting and pivoting of the legs from and to a retracted or folded position, totally contained within the confines of the peripheral skirt, and to the extended and locked position of the finalized assembled or erected stool. The double locking means is also of significance, and which adds strength and safety to this feature of the stool. The specific particulars of the pivotal attachment or suspension of the legs is of substantial significance, as are the features permitting the resilient interengagement of the connecting means during assembly, and subsequently, this feature precludes removal or disassociation.

What is claimed is:

1. A folding stool, comprising:

a top;

leg members on opposite ends of said stool movable selectively to extended stool support positions and folded retracted positions;

interengaging attachment means pivotally and rectilinearly movably connecting said leg members and said top;

said interengaging attachment means including:

lugs extending down from the underside of said top;

attachment guide means on said lugs having open top ends and curvilinear closed bottom ends;

said leg members having support surface contacting ends and stool attachment ends;

circular knobs on said stool attachment ends of said leg members;

said circular knobs being operatively engaged with said attachment guide means and conjointly coactable therewith for selective pivotal and rectilinear movement of said leg members to said extended stool support positions and to said folded retracted positions, said leg members in the extended positions being selectively rectilinearly movable into and out of a locking interengagement with said top.

2. A folding stool as claimed in claim 1, said attachment guide means on said lugs comprising a raised guide forming ridge having a vertical length greater than the diameter of said circular knobs, said guide forming ridge having said curvilinear closed bottom end, said circular knobs being engageable with said curvilinear closed bottom ends for pivotal movement of said leg members, said knobs being rectilinearly movable in said guide forming ridges with said leg members in extended positions to permit said locking interengagement with said top.

3. A folding stool, comprising:

a top;

leg members on opposite ends of said stool movable selectively to extended stool support positions and folded retracted positions;

interengaging attachment means pivotally and rectilinearly movably connecting said leg members and said top;

said interengaging attachment means including:

lugs extending down from the underside of said top;

attachment guide means on said lugs having open top ends and curvilinear closed bottom ends;

a raised guide forming ridge on said lugs having a vertical length greater than the diameter of said circular knobs, said guide forming ridge having said curvilinear closed bottom end, said leg members having support surface contacting ends and stool attachment ends;

circular knobs on said stool attachment ends of said leg members;

said circular knobs being engageable with said curvilinear closed bottom ends for pivotal movement of said leg members, said knobs being rectilinearly movable in said guide forming ridges with said leg members in extended positions to permit said locking interengagement with said top, said circular knobs when operatively engaged with said attachment guide means being conjointly coactable therewith for selective said pivotal and rectilinear movement of said leg members to said extended stool support positions and to said folded retracted positions, said knobs and therefore said leg members in the extended positions being selectively rectilinearly movable into and out of a locking interengagement with said top, said leg members further each including two legs respectively, interconnecting rungs between said legs, said legs being channel shaped in cross-section, said stool attachment ends of said leg members each including two laterally spaced sets of ears having curvilinear shaped ends, said circular knobs being on one said curvilinear shaped ear end in each said set, and disposed toward the other said ear end in a said set, said lugs having said attachment guide means being arranged in pairs with said ridge guide being disposed on facing sides thereof, the spacing of said lugs with said ridge guide thereon being a distance such that said lugs are insertable between said curvilinear ear ends in said sets, said lugs being in operative positionment on opposite sides of said curvilinear ear ends with said knobs operatively engaged within the areas defined by said ridge guides.

4. A folding stool as defined in claim 3, said lugs and said legs being formed of a resilient material, said circular knobs having tapered outer end edges thereon, interengagement of said knobs and said guide ridge being effected by initial engagement of the knob tapered outer ends between said lugs, and upon subsequent respective displacement of one with respect to the other serving to resiliently spread said curvilinear ear ends for positionment of said circular knobs in engagement in said ridge guide forming said attachment guide means, and subsequent disengagement of said circular knobs being prevented by the resilient interengagement of said circular knobs in the guides formed by said ridges.

5. A folding stool as defined in claim 4, the resilient interengagement of said circular knobs within said guide forming ridge by respective movement therebetween resulting in a snap-in engagement of said circular knobs within said guide forming ridge.

6. A folding stool as defined in claim 5, the webs of the channel shaped legs having inset ledges in proximity to the ends having said curvilinear ear ends, said ledges haviang slots therethrough, said top having downwardly extending lugs thereon, said lugs being engageable in said slots upon rectilinear movement of said leg members toward said top with said legs in extended stool support positions, and the interengagement of the lugs in the slots constituting locking means between said leg members and said top with said leg members in the said extended stool supporting positions.

7. A folding stool as defined in claim 6, inner legs of said channel shaped legs of said leg members having, on the opposing inner faces thereof respectively, generally triangular shaped outwardly extending projections, depending webs extending from the undersurface of said top substantially between said ends to which said leg members are attached, said webs having outwardly opening slots in the edges thereof, and in opposite spatial positionment to said projections on said leg faces, said projections being slidably engageable within said slots upon rectilinear movement of said legs when in extended leg supporting position, and upon respective engagement therebetween constituting second leg position locking means.

8. A folding stool as claimed in claim 7, the first and second locking means, when operatively engaged, prevented pivotal movement of the leg members from the extended stool supporting position to the retracted folded position, disengagement of said locking means, upon outward linear displacement of said legs to disengage the respective said locking means, thereafter permitting pivotal movement of said legs to the folded retracted position of said leg members.

9. A folding stool as claimed in claim 8, wherein the channels of said legs of one said leg member have an internal width greater than the external width of the channels of said legs of the other said leg member, the inner leg portion of the larger of said leg channels having a cutout in the end edge, the respective channel width dimensions, in conjunction with the cutaway edge, permitting engagement of the larger dimension channel leg over the smaller dimension channel leg when said leg members are in the folded retracted positions, said cutaway edge accommodating interconnecting leg rungs in the smaller dimension channel leg, the overlapping relationship of the leg members in the folded position thereby providing an overall stool top depth of minimized dimensions.

10. A folding stool as claimed in claim 9, said lugs having said attachment guide means thereon, at that end of said stool having the lesser leg channel width attached thereto, being in closer proximity one to another than said lugs at the opposite end having the legs of greater channel width, said ear ends and said circular knobs on the lesser channel width legs being commensurately spaced for proper interengagement of the respective attachment means for the respective legs.

11. A folding stool as defined in claim 10, including a downwardly extending peripheral skirt on said top, said attachment means for said leg members being disposed within the confines of said peripheral skirt and positioned above the lowermost edge there, said leg members when in the folded retracted position being contained within the confines of said peripheral skirt and above the lower edge thereof, thereby providing a substantially unobstructed bottom to the folding step stool in the folded condition thereof.

12. A folding step stool as defined in claim 11, all of said folding stool being constructed of a resilient, substantially rigid, and strong plastic material.

13. A folding stool as claimed in claim 12, said stool consisting of injection molded plastic material, said top and conjoined portions thereof constituting one molded piece member, and each said leg member constituting a separate molded piece member.

14. A folding article of furniture comprising:

a top;

said top having peripheral edges;

leg support and attachment means mounted to the underside of the top;

support legs pivotally attached to the underside of said top inwardly of said peripheral edges by interengagement with said leg support and attachment means, said legs being selectively and reversably movable to an extended article support position and to a retracted and folded position within the confines of said peripheral edges and beneath the underside of said top by interaction of leg pivot means and said leg support and attachment means;

said support and attachment means consisting of depending lugs on the underside of said top having circular recesses in facing inner sides thereof, said leg members having circular recesses in facing inner sides thereof, said leg members having circular projections having a bevel faced portion and a flat edge portion thereon engaged in said circular recesses, said circular recesses having extended guide edge portions, said circular projections being introducable into and engaged in said guide edge portions by action of said bevel portion and confined in and coacting with the circular recesses for pivotal movement of said legs, said circular projections being rectilinearly movable within said extended edge portions for rectilinear engagement and withdrawal movement of the legs respectively engage and disengage said locking means while retained in the interengaged and pivotal relationship, selectively engageable leg lock means having portions thereof on said top, and portions thereof on said legs respectively, said legs when pivoted to said extended position being rectilinearly movable to selectively engage and to disengage said lock means, pivotal movement of said leg members in the extended position being prevented by said interengaged lock means, and necessitating disengagement of said lock means prior to rotation of said legs to the retracted folded position thereof with said legs confined within said depending peripheral edges.

15. A folding article as claimed in claim 14, wherein said support and attachment means, and said leg members, consist of a relatively rigid but slightly resilient plastic material to permit slight bending thereof to facilitate engagement of said circular projections in said circular recesses due to the bevel portion, and thereafter resilient containment therein by the flat edge portion for pivoting said legs to erected and retracted positions, while preventing disengagement of the legs from the support and attachment means.

16. A folding stool, comprising:

a top;

leg members on opposite ends of said stool movable selectively to extended stool support positions and folded retracted positions;

interengaging attachment means pivotally and rectilinearly movably connecting said leg members and said top;

said interengaging attachment means including:

lugs extending down from the underside of said top;

raised ridge attachment guide means on said lugs having open top ends and curvilinear closed bottom ends;

said leg members having support surface contacting ends and stool attachment ends;

circular knobs on said stool attachment ends of said leg members;

said circular knobs being operatively engaged by and within said attachment guide means and conjointly coactable therewith for selective pivotal and rectilinear movement of said leg members to said extended stool support positions and to said folded retracted positions, said leg members in the extended positions being selectively rectilinearly movable into and out of a locking interengagement with said top;

said knobs being operatively locked within said guide means and operatively being non-removable therefrom.

17. A folding stool as claimed in claim 16, said raised guide forming ridge having a vertical length greater than the diameter of said circular knobs, said guide forming ridge having said curvilinear closed bottom end, said circular knobs being engageable with said curvilinear closed bottom ends for pivotal movement of said leg members, said knobs being rectilinearly movable in said guide forming ridges with said leg members in extended positions to permit said locking interengagement with said top.

18. An article of furniture comprising:

a top support forming member;

said top member having peripheral edges;

leg support and attachment means mounted to the underside of the top member;

a support leg pivotally attached to the underside of said top member inwardly of a said peripheral edge by interengagement with said leg support and attachment means, said leg being selectively and reversibly movable to an extended article support position and to a retracted and folded position within the confines of said peripheral edge and beneath the underside of said top member by interaction of leg pivot means and said leg support and attachment means;

said support and attachment means consisting of a depending lug on the underside of said top having a circular recess in a side thereof, said leg member having a circular projection having a bevel faced portion and a flat edge portion thereon engaged in said circular recess, said circular recess having an extended guide edge portion, said circular projection being introducable into and engaged in said guide edge portion by action of said bevel portion and confined in and coacting with the circular recess for pivotal movement of said leg, said circular projection being rectilinearly movable within said extended edge portion for rectilinear engagement and withdrawal movement of the leg respectively to engage and disengage selectively operable locking means while retained in the interengaged and pivotal relationship;

said selectively engageable leg lock means having portions thereof on said top member, and portions thereon on said leg respectively, said leg when pivoted to said extended position being rectilinearly movable to selectively engage and to disengage said lock means, pivotal movement of said leg member in the extended position being prevented by said interengaged lock means, and necessitating disengagement of said lock means prior to rotation of said leg to the retracted folded position thereof with said leg confined within said peripheral edges.

19. A folding article as claimed in claim 18, wherein said support and attachment means, and said leg member, consist of a relatively rigid but slightly resilient plastic material to permit slight bending thereof to facilitate engagement of said circular projection in said circular recess due to the bevel portion, and thereafter resilient containment therein by the flat edge portion for pivoting said leg to erected and retracted positions, while preventing disengagement of the leg from the support and attachment means.

20. A folding furniture article, comprising:

a support member;

a leg member mounted proximate on end of said support member and movable selectively to an extended support position and folded retracted position;

interengaging attachment means pivotally and rectilinearly movably connecting said leg member and said support member;

said interengaging attachment means including:

lugs extending down from the underside of said support member;

raised ridge attachment guide means on said lug having an open top end and a curvilinear closed bottom end;

said leg member having a support surface contacting end and an article attachment end;

circular knobs on said stool attachment end of said leg member;

said circular knob being operatively engaged by and within said attachment guide means and conjointly coactable therewith for selective pivotal and rectilinear movement of said leg member to said extended support position and to said folded retracted position, said leg member in the extended position being selectively rectilinearly movable into and out of a locking interengagement with said support member;

said knob being operatively locked within said guide means and operatively being non-removable therefrom.

21. A folding stool as claimed in claim 20, said raised guide forming ridge having a vertical length greater than the diameter of said circular knob, said guide forming ridge having said curvilinear closed bottom end, said circular knob being engageable with said curvilinear closed bottom end for pivotal movement of said leg member, said knob being rectilinearly movable in said guide forming ridge with said leg member in extended position to permit said locking interengagement with said support member.

* * * * *